73-151.5
10/12/82 XR 4,354,233 SR

United States Patent [19]

Zhukovsky et al.

[11] 4,354,233

[45] Oct. 12, 1982

[54] ROTARY DRILL AUTOMATIC CONTROL SYSTEM

[76] Inventors: Alexei A. Zhukovsky, ulitsa K. Tsetkin, 32, kv. 43; Vladimir D. Butkin, ulitsa K. Tsetkin, 30-a, kv. 77; Mikhail I. Kulachek, prospekt Pobedy, 155, kv. 134, all of Chelyabinsk, U.S.S.R.

[21] Appl. No.: 162,805

[22] Filed: Jun. 25, 1980

[30] Foreign Application Priority Data

May 3, 1972 [SU] U.S.S.R. ..... 1779660
Feb. 7, 1977 [SU] U.S.S.R. ..... 2451473

[51] Int. Cl.[3] ..... G06F 15/46; G06G 7/48; E21C 1/10

[52] U.S. Cl. ..... 364/420; 73/151.5; 173/6; 175/27; 364/156; 364/511

[58] Field of Search ..... 364/420, 421, 422, 474, 364/505, 506, 511, 800, 804, 807, 148, 156; 173/4–9, 11, 12, 20, 21; 175/24, 27, 39, 40, 45; 73/151, 151.5

[56] References Cited

U.S. PATENT DOCUMENTS 3,541,852 11/1970 Brown et al. ..... 73/151.5
3,752,966 8/1973 Foy, Jr. et al. ..... 364/420
3,785,202 1/1974 Kelseaux et al. ..... 73/151.5
4,165,789 8/1979 Rogers ..... 364/420 X

*Primary Examiner*—Joseph F. Ruggiero
*Attorney, Agent, or Firm*—Burgess, Ryan and Wayne

[57] ABSTRACT

A system for automatic control of a rotary drill comprises a unit for computing the value of drilling tool penetration per single revolution, said unit connected with its inputs to respective transducers and with its output—to an element for comparison of the current value of drilling tool penetration per single revolution thereof with the preset value of such penetration. The preset value of drilling tool penetration is computed by computer means connected with its inputs to respective transducers and to setters of input parameters. With its outputs, the computer means is connected to the element for comparison of the current value of drilling tool penetration per single revolution thereof with the preset value of such penetration, to regulators of drilling tool axial load and rotation frequency and to an element for comparison of the current value of specific drillability of the rock being drilled with the preset value of specific drillability. The system ensures the possibility of automatic or remote control of the drilling process on the basis of information generated on-line in the course of the drilling operation. The system is capable of operation without re-adjustment, in any field, using a drilling tool of pre-selected type. The system operation ensures the minimum energy consumption and cost of drilling at a high efficiency and drilling tool reliability.

13 Claims, 14 Drawing Figures

ROTARY DRILL AUTOMATIC CONTROL SYSTEM

The present invention relates to automation of drilling processes and, more particularly, it relates to systems of automatic control over rotary drills.

Such automatic control systems are designed for use when drilling holes by means of bit- and cutter-type and combination drilling tools while sinking mainly blastholes, as well as prospect holes and deep holes, in mines in the various industries.

In prior art automatic control systems, use is made of the principle of controlling the frequency of the drilling tool rotation in direct proportion to the rate of drilling the rock, and of controlling the axial load on the drilling tool in inverse proportion to the rate of drilling.

For instance, a prior art system of automatic control of a rotary drill, based on controlling the drilling mode parameters according to variable conditions of hole sinking (cf., V.A. Tsygankov, Adaptive System of Control over Drilling Process with Combination Control, Izvestiya VUZov, Instrument Making Series, No. 4, 1971), comprises, connecting to the drill input, regulators of the drilling tool rotation frequency and of the axial load on the drilling tool, each one of said regulators having its own comparison element connected to a setter of the value being controlled. The system further comprises, connecting to the drill outputs, a drilling rate transducer, a transducer of the drilling tool rotation frequency and transducer for the axial load on the drilling tool, all of said transducers having respective instruments for monitoring the drilling mode parameters being measured. The output of the axial load transducer is connected to a divider of constant value K supplied to one of the divider inputs, for the current value of axial load P on the drilling tool. A signal from the divider output is supplied to the input of the comparison element of the regulator of the drilling tool rotation frequency $\omega$, together with a signal setting the minimum value of the drilling tool rotation frequency. The output of the drilling rate transducer is connected to a divider of constant value C supplied to one of the divider inputs, for the current value of drilling rate V. A signal from the divider output is supplied to the input of the comparison element of the regulator of the drilling tool axial load P, together with a signal setting the minimum value of the axial load on the drilling tool.

There is known another embodiment of the prior art system, wherein the drilling tool rotation frequency $\omega$ is controlled directly as a function of drilling rate V, while the axial load is controlled by means of a throttling jet having a fixed value of the cross-sectional area of its passage hole and mounted in the hydraulic system of feeding the drilling tool to the hole face for developing the resistance to the efflux of liquid in the hydraulic system.

Axial load P is controlled in the prior art system by means of a signal proportional to the current drilling rate V, which is supplied from the output of the transducer of drilling rate V to the divider input. Shaped at the divider output is a control signal supplied to the input of the axial load regulator. The higher the current drilling rate V the lower the value of axial load P set on the drilling tool.

The current value of axial load P is measured by the axial load transducer and transmitted to the input of a second divider at whose output there is shaped a signal of control over the regulator of the drilling tool rotation frequency $\omega$. The higher the current value of axial load P the lower the value of rotation frequency $\omega$ set by the automatic control system.

However, prior art systems suffer from a low control accuracy inasmuch as pre-calculated constant coefficients defining the optimum programs of control, which are supplied to divider inputs, are approximate coefficients. The optimum control programs for prior art systems should be precalculated separately for each type of drilling tool, as well as for each type of rock and drilling rig. Optimum program calculations include the choice of the control criterion, calculation of the extreme values of the control criterion for all possible drilling conditions, as well as determining, from the extreme values of the control criterion, the optimum values of the drilling tool rotation frequency and of the drilling tool axial load P. Such calculations are rather elaborate and labor consuming and call for the use of sophisticated computers. The resulting optimum programs are rather inflexible and only applicable to the conditions for which they have been calculated. The degree of deviation of the optimum programs from the conditions of their application cannot be controlled, which leads to additional deterioration of the control accuracy with variation in the drilling conditions.

It is the main object of the present invention to improve the accuracy of automatic control of the optimum parameters upon variation in the drilling conditions.

It is another object of the invention to simplify the means of automatic control.

It is still another object of the present invention to rapidly determine the control criterion in the course of drilling as a function of the drilling mode parameters.

It is yet another object of the invention to provide for separate calculation of the control criterion components for using said components, when required, as particular control criteria.

It is a further object of this invention to build up a set of control criteria for using each of said criteria under the most favorable conditions.

It is still further object of the invention to increase the rate of attaining the optimum drilling rate parameters in the course of drilling.

It is yet further object of the present invention to develop the optimum strategy for controlling the drilling mode parameters.

It is one more object of the invention to increase the rate of search for the optimum values of the drilling mode parameters.

Also an object of the present invention is to increase the rate of adjustment of the drilling mode parameters depending upon the vibration speed of the drilling tool.

It is likewise an object of the invention to attain a rapid feed to the automatic control system of the data on the drilling tool performance.

Still further object of the present invention is to provide for drilling in the mode of minimum consumption of power supplied to the drilling rig because of unproductive reasons such as vibration, friction, etc.

It is one more object of this invention to reduce the number of emergencies in the course of drilling due to a non-optimum drilling mode, as well as to improve the reliability of the drilling equipment.

It is another object of the present invention to provide for low drilling cost at high efficiency.

It is still another object of the invention to improve the drilling rig service conditions in the course of drilling.

It is yet another object of the present invention to minimize the amount of prior information to be supplied in the automatic control system, especially in the functional dependence form, without affecting the control accuracy.

In the accomplishment of said and other objects of the present invention, the automatic control system according to the invention comprises a unit for computing the value of drilling tool penetration per single revolution, said unit connected with its inputs to respective transducers and with its output—to an element for comparison of the current value of drilling tool penetration per single revolution with the preset value thereof computed by computer means connected with its inputs to respective transducers and setters of input parameters and with its outputs—to the element for comparison of the current value of drilling tool penetration per single revolution with the preset value, to regulators of drilling tool axial load and rotation frequency and to an element for comparison of the current value of specific drillability of the rock being drilled with the preset value.

Such an arrangement of the disclosed system helps considerably to improve the accuracy of automatic control over the drilling mode parameters and, at the same time, simplify means of control.

It is expedient that a unit for computing the control criterion be made as a divider to whose inputs multipliers are connected generating, respectively, the current value of the power applied to the drilling tool feed and that of the power of rotation for the rock being drilled from signals from appropriate transducers supplied to multiplier inputs.

This provides a possibility of rapidly determining, in the course of drilling, the control criterion in the form of feed power-to-drilling power ratio as a function of the drilling mode parameters.

It is expedient that a unit for setting the value of axial load on the drilling tool be made as a compensating unit connected to the element for comparison of the current value of specific drillability of the rock being drilled with the preset value, and operating when the control criterion has the optimum value in the course of controlling the axial load on the drilling tool by means of an axial load value setter connected via switch to the axial load regulator.

This helps to effect the setting of the optimum value of the axial load on the drilling tool both at a constant value of the drilling tool rotation frequency and upon simultaneous adjustment of the drilling tool rotation frequency and axial load, thereby reducing the time required for setting the optimum value of axial load.

It is expedient that a unit for setting the value of the drill tool rotation frequency be made as a compensating unit connected to the element of comparison of the current value of drilling tool penetration with the preset value, and operating when the control criterion has the optimum value in the course of controlling the rotation frequency with the aid of a rotation frequency value setter connected via switch to the rotation frequency regulator.

This helps to effect the setting of the optimum value of the drilling tool rotation frequency both at a constant value of axial load on the drilling tool and upon simultaneous adjustment of the drilling tool axial load and rotation frequency, thereby reducing the time required for setting the optimum value of the drilling tool rotation frequency.

It is expedient that a unit for computing the drilling cost be made as an adder whose one input is connected via intermediate divider to an output of another divider to which inputs signals are supplied that correspond to the current value of drilling tool penetration per single revolution and to the drilling tool cost, another input of said intermediate divider being connected to a setter of the drilling tool motor potential, while a second input of the adder is connected, via another intermediate divider connected with its one input to a drilling rate transducer, to an output of another adder to whose one input a signal is supplied corresponding to the drilling rig depreciation cost and service personnel wages and whose other input is connected to a multiplier to whose separate inputs signals are supplied corresponding to the cost per unit electric power spent and power consumed by the drilling rig.

Such an arrangement of the drilling cost computing unit makes for separate computation, from the current parameter values supplied to the inputs of the drilling cost computing unit, particular cost values relating to the drilling tool and other outlay, as well as for using them, when required, as particular control criteria for controlling the drilling rig mode.

When controlling the drill tool rotation frequency, it is expedient that the drilling tool motor potential setter be made as a potentiometer.

While simplifying the design, this enables one to rapidly set, prior to drilling, a constant motor potential value independent of the rotation frequency of the drilling tool used, said drilling tool being of known type.

When controlling the axial load on the drilling tool, it is preferred that the drilling tool motor potential setter be made as a functional generator for converting the current value of drilling tool axial load to the motor potential function of the value of said load.

This enables one, while utilizing the motor potential dependence upon the drilling tool axial load that is known for the type of drilling tool used in drilling, to readily and rapidly find in the course of drilling the current value of the drilling tool motor potential, and adds flexibility to the automatic control system.

It is expedient that computer means be provided with an optimizing controller whose input is connected to the output of the unit for computing the control cirterion while the output is connected via switch to one of the inputs of the element for comparison of the current value of specific drillability of the rock being drilled with the preset value or to the input of the axial load regulator.

This helps increase the rate of search for the optimum values of axial load on the drilling tool with the aid of the automatic control system without affecting the accuracy of control, especially when drilling alternating rocks with sharply varying properties.

It is expedient that computer means be provided with an optimizing controller whose input is connected to the output of the unit for computing the control criterion while the output is connected via switch to one of the inputs of the element for comparison of the current value of drilling tool penetration per single revolution with the preset value or to the input of the drilling tool rotation frequency regulator.

This helps to increase the rate of search for the optimum values of the drilling tool rotation frequency with the aid of the automatic control system without affecting the accuracy of control, especially when drilling alternating rocks with sharply varying properties.

Computer means should be made complete with a unit for limiting the drilling tool rotation frequency in the form of an element for comparison of the current value of vibration speed with the preset value, the output of said element being connected via locking element to the drilling tool rotation frequency regulator.

Such an arrangement of the computer means helps to effect a rapid adjustment of the drilling tool rotation frequency in case the vibration speed value gets in excess of the value preset by the setter.

Computer means should be made complete with a unit for limiting the drilling tool axial load in the form of an element for comparison of the current value of vibration speed with the preset value, the output of said element being connected via locking element to the axial load regulator.

This helps to effect a rapid adjustment of the axial load on the drilling tool in case the vibration speed value gets in excess of the value preset by the setter.

The present invention will be better understood upon considering the following detailed description of examplary embodiments thereof to be taken in conjunction with the accompanying drawings in which.

The basic principle of the herein disclosed automatic control system consists in that the control parameters used include the optimum value of drilling tool penetration per single revolution, the optimum value of specific drillability, the value of drilling tool motor potential, as well as energy ratios in the course of drilling which result in the minimum unproductive consumption of energy supplied to the drilling tool. The data essential for the functioning of the control system are generated on-line, continuously in the course of drilling, and utilized immediately for the control over the drilling rig in accordance with the control criterion selected by the operator from a set of criteria available in the automatic control system.

Figure 1:
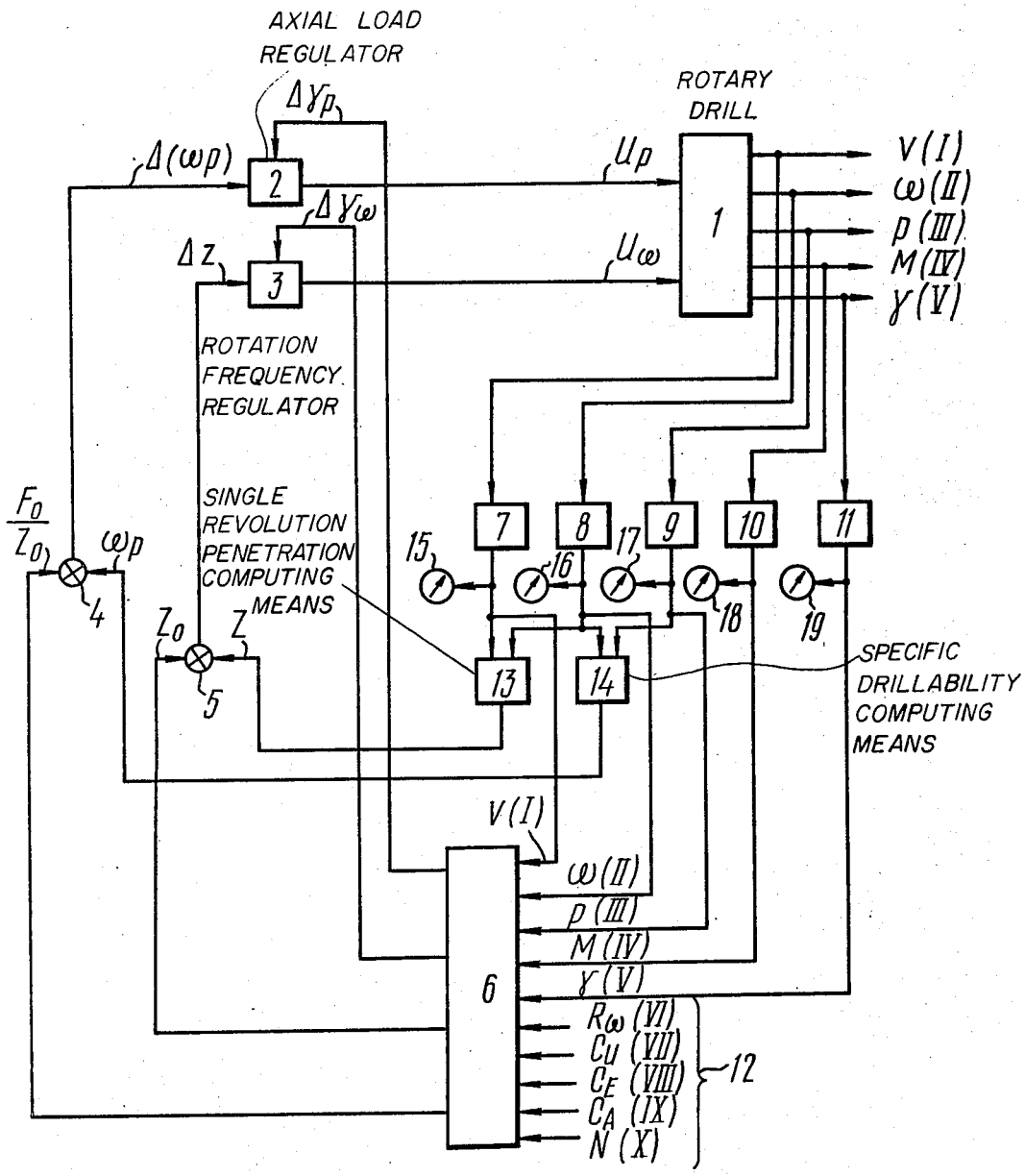
FIG. 1 is a block diagram of the system for automatic control over a rotary drill, according to the present invention.

A block diagram of the system for automatic control over a rotary drill, according to the present invention, is presented in FIG. 1.

The herein disclosed system for automatic control over a rotary drill 1 comprises a regulator 2 of axial load P on the drilling tool (not shown in the drawing) and a regulator 3 of the drilling tool rotation frequency $\omega$, both said regulators connected to the inputs of the drill 1. The regulators 2 and 3 are connected via their own respective comparison elements 4 and 5 to the corresponding outputs of computer means 6.

Connected to the appropriate outputs of the rotary drill 1 is a transducer 7 of drilling rate V, a transducer 8 of the drilling tool rotation frequency $\omega$, a transducer 9 of axial load P on the drilling tool, a transducer 10 of torque M on the drilling tool, and a transducer 11 of vibration speed $\nu$. The outputs of the transducers 7, 8, 9, 10 and 11 are connected to respective inputs 1, II, III, IV and V of the computer 6.

In addition, to inputs VI, VII, VIII, IX and X of the computer 6 are applied signals 12 corresponding to the values of drilling tool motor potential $R_\omega$, drilling tool cost $C_u$, the cost $C_E$ of electric power consumed by the drill 1, depreciation cost $C_A$ of the drill 1 including the service personnel wages, and of power N consumed by the drill 1. These values are presented in the form of settings by means of potentiometers, as described in more detail below.

The automatic control system of the invention comprises a unit 13 for computing the current value of drilling tool penetration per single revolution, said unit connected with its inputs to the respective transducers 7 of drilling rate V and 8 of the drilling tool rotation frequency $\omega$, and with its output—to the element 5 for comparison of the current value of drilling tool penetration Z per single revolution with the preset penetration value $Z_o$ generated by the computer 6.

Such an arrangement of the control system makes for a continuous and automatic control over the drilling tool efficiency from its current penetration value Z by precluding inefficient operating modes of the drill 1 at low drilling rates V.

Introduced in the automatic control system as a control parameter is the specific drillability factor F/Z.

Drillability factor F is a value proportional to the power PV of drilling tool feed to the hole face. In one and the same drilling mode, drillability factor F has a specific value corresponding to each particular type of rock being drilled since the drilling rate differs depending upon the type of rock (cf., V.S. Vladislavlev, Destruction of Rocks upon Drilling Holes, Gostopterhizdat Publishers, Moscow, 1958, in Russian).

Now, specific drillability factor F/Z defines the drillability of rock in relation to the drilling tool penetration value Z per single revolution, i.e., said ratio F/Z takes into account the type and state of the drilling tool.

The current value of specific drillability F/Z can be expressed as the product $P_\omega$ of the value of drilling tool axial load P by the value of the drilling tool rotation frequency $\omega$, since the factor F/Z can be presented as PV/Z or PV $\omega$/V, i.e. P$\omega$.

Specific drillability factor F/Z assumes the optimum value $F_o/Z_o$ at which the selected control criterion such as drilling cost C or some other control criterion has an extremum value, this being the case at certain values of the drilling mode parameters $P_o$ and $\omega_o$ which are optimum drilling mode parameters from the viewpoint of the control criterion selected.

The automatic control system of the invention comprises a unit 14 for computing the current value of specific drillability factor F/Z as the product $\omega$P of the current values of drilling tool axial load P and the drilling tool rotation frequency $\omega$, said unit 14 connected with its inputs to the transducer 8 of the drilling tool rotation frequency $\omega$ and to the transducer 9 of axial load P on the drilling tool, and with its output—to the element 4 for comparison of the current value of specific drillability F/Z in the form of the product $\omega$P of the drilling tool axial load P by the drilling tool rotation frequency $\omega$ with the computer-generated optimum value $F_o/Z_o$ of specific drillability F/Z of the rock being drilled. This makes for an automatic control over the current value $\omega$P of specific drillability F/Z in the course of operation of the drill 1, precluding drilling modes at which the specific drillability factor F/Z is as low as to affect the efficiency of the drill 1.

Also applied to the inputs of the regulator 2 of axial load P and of the regulator 3 of the drilling tool rotation frequency $\omega$ from the corresponding outputs of the computer 6 are signals $\Delta\gamma_P$ and $\Delta\gamma_\omega$ of limiting the axial load P and drill rotation frequency $\omega$, respectively. The introduction of online restrictions of axial load P and drill rotation frequency $\omega$ makes for a stable operation of the drill 1, free of strong vibrations and shaking, and for increased reliability of the drilling equipment.

The automatic control system of the invention is provided with requisite monitoring instruments 15, 16, 17, 18 and 19 designed to respectively indicate, in the course of drilling, the current values of drilling rate V, drilling tool rotation frequency $\omega$, axial load P on the drilling tool, torque M on the drilling tool and vibration speed $\gamma$.

Figure 2:
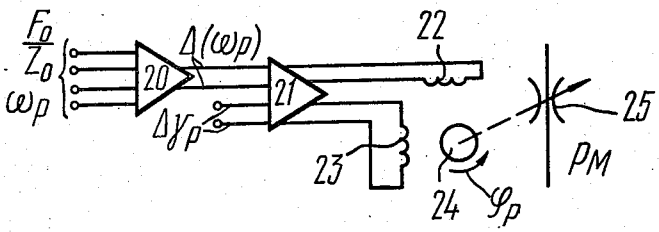
FIG. 2 illustrates an embodiment of the drilling tool axial load regulator with a comparison element, according to the present invention.

FIG. 2 illustrates an embodiment of the regulator 2 of axial load P and the element 4 for comparison of the current value of specific drillability F/Z in the form of the product $\omega$P of the drilling tool rotation frequency $\omega$ by axial load P with the optimum value $F_o/Z_o$ of specific drillability of the rock being drilled generated by the computer 6.

The comparison element 4 of the regulator 2 of the axial load P has an amplifier 20 to which input signals are applied corresponding to the value $F_o/Z_o$ of specific drillability and to the product $\omega$P of the current value of drilling tool axial load P by the current value of drilling tool rotation frequency $\omega$, while the output is connected to an input of an amplifier 21 of the regulator 2 of the axial load P. Supplied to a second input of the amplifier 21 is a signal $\Delta\gamma_P$ corresponding to the difference between the vibration speed current value $\gamma$ and preset value $\gamma_P$. The output of the amplifier 21 is electrically connected to windings 22, 23 of a servomotor whose rotor 24 is rigidly connected with a hydraulic throttle 25 serving to control pressure $P_M$ in the hydraulic feed system of the drill 1.

The amplifier 20 is used for comparing the signals corresponding to the optimum value $F_o/Z_o$ of specific drillability and to the product $\omega$P of the current values of the drilling tool axial load P and drilling tool rotation frequecy $\omega$. The amplifier 21 is used for comparing the signal $\Delta\gamma_P$ corresponding to the difference between the vibration speed current value $\gamma$ and preset value $\gamma_P$ with a signal $\Delta$ ($\omega$P) corresponding to the difference between the value $F_o/Z_o$ of specific drillability and the product $\omega$P of the current values of drilling tool axial load P and drilling tool rotation frequency $\omega$. While rotating, the rotor 24 of the servomotor turns the hydraulic throttle 25 through an angle $\phi_P$ to set the oil pressure $P_M$ in the hydraulic feed system of the drill 1 at a level corresponding to the input values of the regulator 2 of the axial load.

Figure 3:
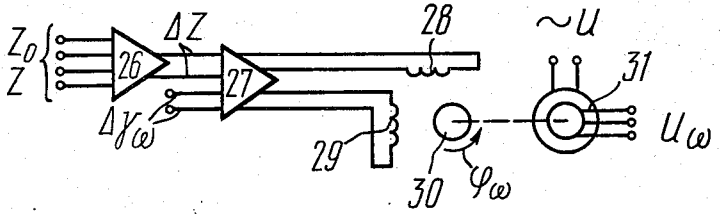
FIG. 3 illustrates an embodiment of the drilling tool rotation frequency regulator with a comparison element, according to the present invention.

The regulator 3 of the drilling tool rotation frequency $\omega$ and the element 5 for comparison of the current value Z of drilling tool penetration per signal revolution with the optimum value $Z_o$ of such penetration generated by the computer 6 are shown in FIG. 3 in a possible embodiment thereof.

The comparison element 5 of the regulator 3 of the drilling tool rotation frequency $\omega$ has an amplifier 26 to whose inputs signals are applied corresponding to the preset value $Z_o$ of drilling tool penetration per single revolution and to the current value Z of such penetration, while the output is connected to an input of an amplifier 27 of the rotation frequency regulator 3. Supplied to a second input of the amplifier 27 is a signal $\Delta\gamma_\omega$ corresponding to the difference between the vibration speed current value $\gamma$ and preset value $\gamma_\omega$. The output of the amplifier 27 is electrically connected to windings 28, 29 of a servomotor whose rotor 30 is rigidly connected with a selsyn 31 used as the setter of control signal $U_\omega$ applied to the input of the electric drive of a motor serving to impart rotation to the working member of the drill 1.

The amplifier 26 is used for comparing the signals corresponding to the preset value $Z_o$ of drilling tool penetration per single revolution and to the current value Z of such penetration. The amplifier 27 is used for comparing the signal $\Delta\gamma_\omega$ corresponding to the difference between the vibration speed current value $\gamma$ and preset value $\gamma_\omega$ with a signal $\Delta\zeta$ corresponding to the difference between the preset value $Z_o$ of drilling tool penetration per single revolution and current value Z of such penetration. While rotating, the rotor 30 of the servomotor turns the rotor of the selsyn 31 through an angle $\phi_\omega$ to set a value $U_\omega$ of the output signal of the selsyn 31 corresponding to the input values of the drilling tool rotation frequency regulator 3.

Well-known multiplication-division devices described in literature (cf., E. D. Lrbedev et al., Controlling D.C. Valve-Type Electric Motors, Energhiya Publishers, Moscow, 1970, in Russian) can be used as the unit 13 for computing the current value Z of drilling tool penetration per single revolution and the unit 14 for computing the current value of specific drillability of the rock as the product $\omega$P of the current values of drilling tool axial load P and drilling tool rotation frequency $\omega$.

Left undescribed in the diagrams (FIGS. 2 and 3) are the servomotors 22, 23, 24 and 28, 29, 30, the throttle 25 and selsyn 31, since they are well known and described in literature (cf., F. M. Yuferov, Electric Motors of Automatic Devices, Gosenergoizdat Publishers, 1959, in Russian; Hydraulic Equipment, a reference catalog, Parts I and II, Moscow, 1967, in Russian).

In the course of operation of the drill 1, the current values of drilling rate V, drilling tool rotation frequency $\omega$, axial load P on the drilling tool and input parameters 12 are used by the computer 6 for computing the optimum (with respect to the control criterion selected by the operator) values of drilling tool penetration per single revolution, $Z_o$, and of specific drillability of the rock being drilled, $F_o/Z_o$. At the same time, the units 13 and 14 compute the current values of drilling tool penetration Z per single revolution and of the product $\omega P$ of the drilling tool rotation frequency $\omega$ by the drilling tool axial load P.

The obtained current and computed optimum values $\omega P$ and $F_o/Z_o$, Z and $Z_o$, are compared in the respective comparison elements 4 and 5. The signal difference $\Delta Z$ obtained at the output of the comparison element 5 is applied to the input of the drilling tool rotation frequency regulator 3 which acts to adjust the drilling tool rotation frequency $\omega$ until said difference $\Delta Z$ comes close to zero. The signal difference $\Delta(\omega P)$ obtained at the output of the comparison element 4 is applied to the input of the regulator 2 of the axial load which acts to adjust the axial load P until said difference $\Delta(\omega P)$ comes close to zero.

Also computed by the computer 6 are the signals $\Delta\gamma P$ and $\Delta\gamma_\omega$ of limiting the drilling tool axial load P and rotation frequency $\omega$, respectively, which signals are supplied to the regulators 2 and 3 of the drilling tool axial load P and rotation frequency $\omega$ for correcting the current values of the drilling mode parameters P and $\omega$ such as to render the operation of the drill 1 free of strong vibrations harmful to the service personnel and affecting the reliability of the drilling equipment.

Following the automatic adjustment of the parameters P and $\omega$ to their optimum values $P_o$ and $\omega_o$, the drill 1 operates without changes in the drilling mode until a change occurs in the properties of the rock being drilled. Such a change in the rock properties causes a variation in the current value Z of the drilling tool penetration per single revolution, which results in the emergence of a different $\Delta Z$ between the signals corresponding to Z and $Z_o$ at the output of the element 5 for comparison of said signals. The drilling tool rotation frequency regulator 3 acts to adjust the rotation frequency $\omega$, which causes a change in the value of the product $\omega P$ of the rotation frequency $\omega$ by the axial load P and subsequent adjustment of the axial load P by means of the axial load regulator 2. At the same time, the computer 6 generates the optimum values of specific drillability, $F_o/Z_o$, and of drilling tool penetration per single revolution, $Z_o$. The adjustment process terminates when the value $\Delta Z$ of the different between the optimum penetration value $Z_o$ and current penetration value Z at the output of the element 5 for comparison of said values and the valve $\Delta(\omega P)$ of the difference between the optimum value $F_o/Z_o$ of specific drillability and the current value of the product $\omega P$ of the drilling tool rotation frequency $\omega$ by axial load P at the output of the element 4 for comparison of said values become equal to zero. While so doing, the drill starts operating in a new mode wherein the values of the parameters $\omega$ and P correspond to the optimum values of the new type or rock being drilled. Under conditions of inceasing variation of the properties of the rock being drilled, the adjustment of the parameters and P is likewise continuous. For example, an increase in the rock hardness is accompanied with a reduction of the drilling tool rotation frequency $\omega$ and an increase of the axial load P. Accordingly, a reduction in the rock hardness is accompanied with an increase of the drilling tool rotation frequency $\omega$ and a reduction of the axial load P. When drilling a homogeneous rock of uniform hardness, the mode parameters $\omega$ and P are stable.

Figure 4:
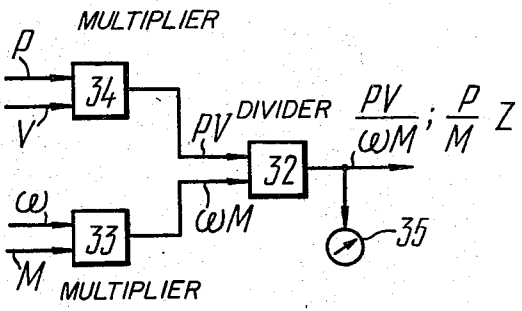
FIG. 4 is a block diagram of the unit for computing the control cirterion in a specific embodiment using the ratio of the drilling tool feed power value of the rock drilling power value as the control criterion, according to the present invention.

In the computer 6 several control criteria can be used, at the operator's discretion. FIG. 4 illustrates an embodiment of the unit for computing the control criterion of the computer 6, using the ratio of the power PV of feeding the drilling tool to the hole face to the power $\omega M$ of drilling the rock with the drilling tool ($PV/\omega M$) as the control criterion. The use of such control criterion for controlling the drilling mode parameters $\omega$ and P helps minimize the unproductive consumption of power by the drill 1.

In this case, the unit for computing the control criterion is made as a divider 32 to whose inputs multipliers 33 and 34 are connected. Supplied to the input of the multiplier 34 from appropriate transducers are signals corresponding to the current values of axial load P on the drilling tool and drilling rate V. Supplied to the input of the multiplier 33 from appropriate transducers are signals corresponding to the current values of the drilling tool rotation frequency $\omega$ and torque M. The values of the power PV of feeding the drilling tool to the hole face and of the power $\omega M$ of drilling the rock with the drilling tool, obtained at the output of the multipliers 34 and 33, are applied to the input of the divider 32 at whose output there is computed the ratio $PV/\omega M$ of feed power PV to the drilling power $\omega M$. Provided at the output of the divider 32 is an indicator 35 of the ratio $PV/\omega M$.

By making use of the unit for computing the control criterion, shown in FIG. 4 and by means of manual regulators of the drilling tool rotation frequency 10 and axial load P provided in the electric drive of the drill working member, one can set the optimum values of the drilling tool rotation frequency $\omega$ and axial load P corresponding to the extreme value of the control criterion.

The afore-described divider 32 and multipliers 33 and 34 are well known from literature; they are used in the system of the invention for their direct purpose.

Figure 5:
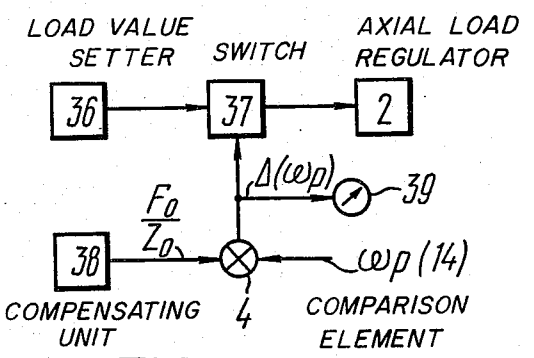
FIG. 5 is a block diagram of the unit for setting the value of axial load on the drilling tool, according to the present invention.
Figure 7:
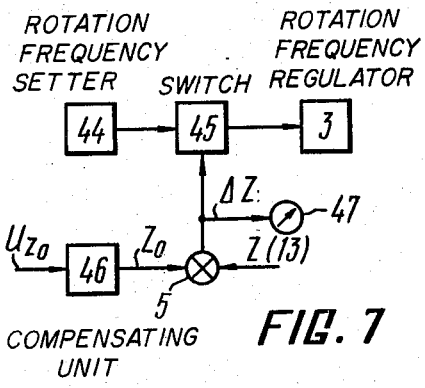
FIG. 7 is a block diagram of the unit for setting the value of the drilling tool rotation frequency, according to the present invention.

For proper adjustment of the automatic control system prior to operation, the computer 6 includes a unit for setting the value of axial load P on the drilling tool (FIG. 5) and a unit for setting the value of drilling tool rotation frequency $\omega$ (FIG. 7).

The unit for setting the value of axial load P on the drilling tool (FIG. 5) includes a setter 36 of the value of said load P connected via switch 37 to the input of the drilling tool regulator 2, of the axial load P, and a compensating unit 38 whose output is also connected to the input of the axial load regulator 2 via the element 4 for comparison of the current value of the product $\omega P$ of the drilling tool rotation frequency $\omega$ by the drilling tool axial load P and the switch 37 with the optimum values of specific drillability of rock $F_o/Z_o$. The comparison element 4 has an indicator 39 of the difference between the product $\omega P$ of the drilling tool rotation frequency $\omega$ by axial load P and the value $F_o/Z_o$ of specific drillability of the rock being drilled.

Such an arrangement of the unit for setting the value of the axial load P helps, simultaneously with setting the axial load P, finding the optimum value $F_o/Z_o$ of specific drillability of the rock being drilled from the current value of the product $\omega P$ of the rotation frequency $\omega$ by axial load P.

Figure 6:
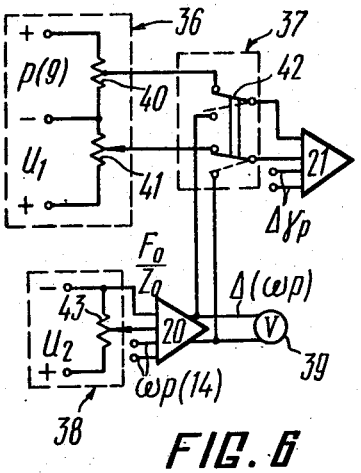
FIG. 6 illustrates an embodiment of the unit for setting the value of axial load on the drilling tool, according to the present invention.

Described below is an embodiment of the unit for setting the value of axial load P on the drilling tool, as shown in FIG. 6.

The setter 36 of the value of axial load P includes series-connected resistors 40, 41, the input of the resistor 40 being connected with the axial load transducer 9 and the input of the resistor 41—with a source of setting signal $U_1$. The switch 37 is made as a two-pole tumbler 42 one of whose inputs is connected to the output of the setter 36 of the value of axial load P and the other input—to the output of the amplifier 20. The output of the tumbler 42 is connected to the input of the amplifier 21 of the regulator 2 of the axial load. The compensating unit 38 is made as a resistor 43 whose input is connected to a source of setting signal $U_2$ and the output—to the input of the amplifier 20 of the element 4 for comparison of the current value of the product $\omega P$ of the drilling tool rotation frequency $\omega$ by the drilling tool axial load P with the optimum value of specific drillability of rock $F_o/Z_o$.

With a constant drilling tool rotation frequency $\omega$ preset by the operator in accordance with the value equal to an average value in the rotation frequency adjustment range, the setter 36 is used to adjust the drilling tool axial load P towards increasing until the indicator 35 (FIG. 4) displays the maximum value of the ratio $PV/\omega M$ of the drilling tool feed power PV to the rock drilling power $\omega M$. The compensator 38 helps to compensate the current value of specific drillability factor $\omega P$ such that the signal difference $\Delta(\omega P)$ at the output of the element 4 for comparison of the value $\omega P$ and the value $F_o/Z_o$ of specific drillability should be equal to zero. The afore-described operations are repeated at other values of the drilling tool rotation frequency $\omega$ to attain the minimum reading of the maximum value of the ratio $PV/\omega M$ of the feed power PV to drilling power $\omega M$ displayed by the indicator 35. The signal value obtained at the output of the compensator 38 after the last compensation is the optimum value $F_o/Z_o$ of specific drillability of the rock being drilled, corresponding to the optimum values of the drilling tool rotation frequency $\omega$ and drilling tool axial load P.

The unit for setting the value of the drilling tool rotation frequency $\omega$ (FIG. 7) includes a setter 44 of the value of said frequency $\omega$ connected via switch 45 to the input of the rotation frequency regulator 3, and a compensating unit 46 whose output is also connected to the input of the rotation frequency regulator 3 via the element 5 for comparison of the current value Z of drilling tool penetration per single revolution with the preset value $Z_o$ of such penetration and the switch 45. The comparison element 5 has an indicator 47 of the difference between the preset penetration value $Z_o$ and current penetration value Z per single revolution of the drilling tool. Such an arrangement of the unit for setting the value of the rotation frequency $\omega$ helps, simultaneously with setting the rotation frequency $\omega$, finding the optimum value $Z_o$ of the drilling tool penetration from the current value Z of such penetration.

Figure 8:
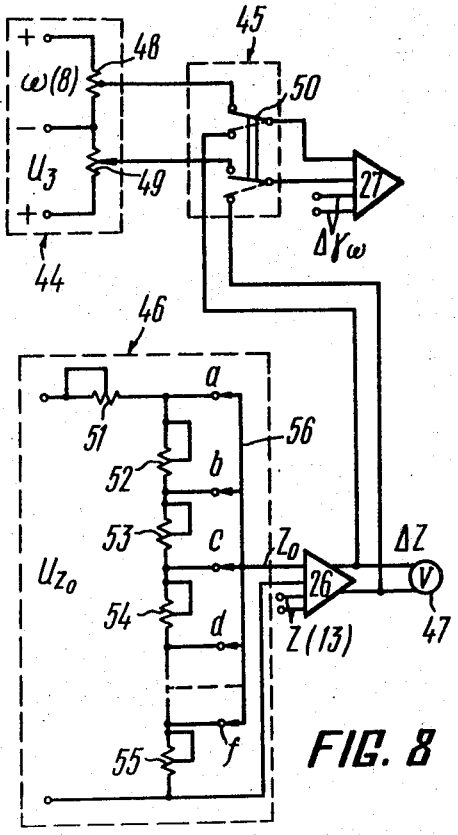
FIG. 8 illustrates an embodiment of the unit for setting the value of the drilling tool rotation frequency, according to the present invention.

An embodiment of the unit for setting the value of rotation frequency 10 is shown in FIG. 8.

The setter 44 of the value of drilling tool rotation frequency $\omega$ includes series-connected resistors 48, 49, the input of the resistor 48 being connected with the drilling tool rotation frequency transducer 8 and the input of the resistor 49—with a source of setting signal $U_{33}$. The switch 45 is made as a two-pole tumbler 50 one of whose inputs is connected to the output of the setter 44 of the drilling tool rotation frequency $\omega$ and the other input—to the output of the amplifier 26 of the element 5 for comparison of the current value Z of drilling tool penetration per signle revolution with the preset value $Z_o$ of such penetration. The output of the tumbler 50 is connected to the input of the amplifier 27 of the drilling tool rotation frequency regulator 3. The compensating unit 46 includes series-connected resistors 51, 52, 53, 54, 55 connected with a switch 56, the input of the series-connected resistors 51, 52, 53, 54, 55 being connected to a source of setting voltage $UZ_o$ and the output of each one of said resistors—to respective input terminals a, b, c, c, . . . , f of the switch 56. The output of the switch 56 is connected to the input of the amplifier 26 of the element 5 for comparison of the current value Z of drilling tool penetration per single revolution with the preset value $Z_o$ of such penetration. The resistors 51, 52, 53, 54, 55 are provided with means for adjusting the value of their resistance such as to maintain across each one of said resistors a voltage proportional to the penetration value $Z_o$ of one of the drilling tool types. The number of resistors should correspond to the number of drilling tool types used for drilling.

With a constant axial load P on the drilling tool, preset by the operator, the setter 44 is used to adjust the drilling tool rotation frequency $\omega$ towards increasing until the indicator 35 (FIG. 4) displays the minimum value of the ratio $PV/\omega M$ of the drilling tool feed power PV to the rock drilling power $\omega M$. The compensator 46 helps to compensate the current value Z of drilling tool penetration such that the difference $\Delta Z$ between the current penetration value Z and preset value $Z_o$ at the output of the comparison element 5 should be equal to zero. The afore-described operations are repeated to attain the minimum possible value of the ratio $PV/\omega M$ of the feed power PV to drilling rock power $\omega M$.

The signal value obtained at the output of the compensator 46 after the last compensation is the optimum value $Z_o$ of drilling tool penetration per single revolution.

Following the adjustment of the automatic control system, it is switched over to the mode of automatic control of the drill by means of the switches 37 and 45, and operates unattended.

The optimum value $Z_o$ of drilling tool penetration per single revolution may be preset if there is known the value of such penetration $Z_o$ for the type of drilling tool used, depending on the geometric parameters of the tool or on technological considerations. In this case, the adjustment of the automatic control system consists essentially in setting, with the aid of the unit for setting the value of drilling tool axial load P (FIG. 5), the optimum value $F_o/Z_o$ of specific drillability of the rock being drilled, with the drilling tool rotation frequency $\omega$ being automatically controlled. In this case, in the automatic control system use is made of the control criterion $(P/M).Z_o$ equalling the ratio of axial load P to torque M on the drilling tool multiplied by the optimum value $Z_o$ of drilling tool penetration per single revolution.

Figure 9:
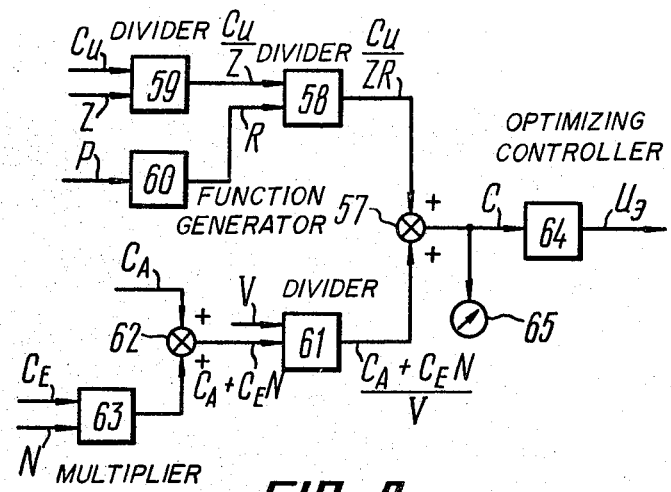
FIG. 9 is a block diagram of the unit for computing the control criterion in a specific embodiment using the current cost of drilling as the control criterion, according to the present invention.

FIG. 9 illustrates an embodiment of the unit for computing the control criterion of the computer 6, wherein the drilling cost C is used as the control criterion. The unit for computing the drilling cost C is made as an adder 57 whose one input is connected via intermediate divider 58 to an output of another divider 59 to whose inputs are supplied signals corresponding to the current value Z of drilling tool penetration per single revolution and to the cost $C_n$ of one drilling tool. Supplied to one of the inputs of the intermediate divider 58 from the divider 59 is the value of the ratio $C_n/Z$ of drilling tool cost $C_n$ to drilling tool penetration Z per single revolution, and to the other input—the value of drilling tool motor potential R either in the form of function $R_P$ of the axial load P generated by a functional generator 60 for converting said load value P or in the form of a preset constant value $R_\omega$.

A second input of the adder 57 is connected via intermediate divider 61 to an output of an adder 62 to one of whose inputs there is supplied a signal $C_A$ corresponding to the cost of drill tool depreciation and service personnel wages.

Connected to a second input of the adder 62 is a multiplier 63 to whose inputs are supplied signals $C_E$ and N corresponding to the cost of one kilowatt-hour of electric energy and to the power consumed by the drill, respectively. To the second input of the intermediate divider 61 there is supplied from the drilling rate transducer 7 a signal corresponding to the current value of the drilling rate V. The output of the adder 57 is connected to an otpimizing controller 64. The output of the adder 57 is further provided with an indicator 65 of the current value of drilling cost C.

The arrangement of the unit for computing the drilling cost in accordance with the diagram shown in FIG. 9 provides a possibility, when required, of using particular cost criteria relating to the drilling tool and other outlay for controlling the drilling mode parameters.

The afore-described (and shown in the diagram of FIG. 9) multiplier 63, dividers 58, 59, 61, optimizing controller 64, functional generator 60 and indicator 65 are known from literature (cf., E. D. Lebedev et al., Controlling D.C. Valve-Type Electric Motors, Energhiya Publishers, Moscow, 1970, in Russian) and are used in the system according to the present invention for their direct purpose.

In the course of operation of the unit for computing the drilling cost, the current value of drilling cost C corresponding to the operating conditions of the drill 1 is being continuously computed from the current values of signals corresponding to drilling rate V, axial load P and drilling tool penetration Z per single revolution supplied by the drilling rate transducer 7, drilling tool axial load transducer 9 and the unit 13 for computing the current value Z of drilling tool penetration, as well as from signals preset at the inputs of the unit for computing the drilling cost C and corresponding to drilling tool cost $C_n$, cost $C_E$ of one kilowatt-hour of electric energy consumed by the drill, cost $C_D$ of depreciation of the drill 1 and of service personnel wages, and to power N consumed by the drill 1. The computed current value of drilling cost C is applied to the input of the optimizing controller 64 which adjusts the drilling tool rotation frequency $\omega$ or axial load P on said drill until the cost C reaches its extreme value corresponding to the properties of the rock being drilled. Upon variation of those properties, the value of calculated cost C also changes and the optimizing controller 64 searches for the new extreme of cost C by setting other values of rotation frequency $\omega$ and axial load P corresponding to the optimum ones, when drilling rock with new properties. The manner in which the automatic control system operates with the optimizing controller 64 provides a possibility of obviating the step of pre-adjusting said system. When drilling rocks of markedly alternating properties, the search for the optimum values $\omega_o$ and $P_o$ of rotation frequency and axial load P by means of the optimizing controller 64 is carried out continuously.

The automatic control system of the invention makes a separate search for the optimum values $\omega_o$ and $P_o$ of each of the parameters $\omega$ and P and for their simultaneous search resulting in an increased speed of response of the control system and improved accuracy of control. To this end, the optimizing controller 64 (FIG. 10) is connected with its input to the output of the unit for computing the control criterion made as shown in FIG. 4 or FIG. 9, and with its output, via switch 66, to one of the inputs of the element 4 for comparison of the preset value $F_o/Z_o$ of specific drillability of the rock being drilled with the current value of the product $\omega P$ of drill rotation frequency $\omega$ by axial load P in case the axial load P is being controlled. When controlling the rotation frequency $\omega$, the optimizing controller 64 is connected with its output via switch 67 (FIG. 11) to one of the inputs of the element 5 for comparison of the current value Z of drilling tool penetration with the preset value $Z_o$ of such penetration.

Figure 10:
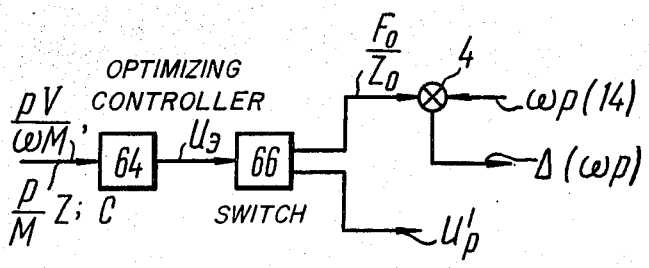
FIG. 10 is a block diagram illustrating the connection of the optimizing controller to the element for comparison of the current value of specific drillability of the rock being drilled with the preset value, according to the present invention.
Figure 11:
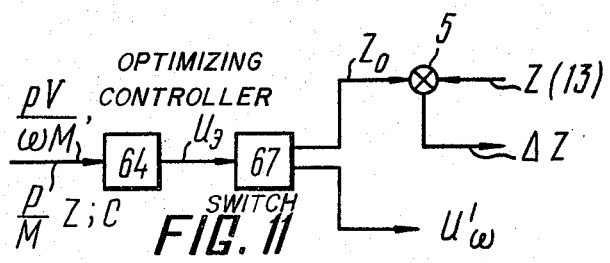
FIG. 11 is a block diagram illustrating the connection of the optimizing controller to the element for comparison of the value of drilling tool penetration with the preset value, according to the present invention.

In one of the embodiments according to the diagrams shown in FIG. 10 and 11, two-position two-pole tumblers can be used as the switches 66 and 67.

In case the optimizing controller 64 is connected via switch 66 to one of the inputs of the element 4 for comparison of the current value of the product $\omega P$ of drilling tool rotation frequency $\omega$ by axial load P with the preset value $F_o/Z_o$ of specific drillability of the rock being drilled, the search by said controller 64 for the extreme value of the operator-selected control criterion such as drilling cost C, ratio $PV/\omega M$ of the drilling tool feed power PV to the rock drilling power $\omega M$ or the ratio of axial load P to torque M multiplied by the current value $Z_o$ of drilling tool penetration is accompanied with the adjustment of the value $F_o/Z_o$ of specific rock drillability and, at the same time, of drilling tool axial load P and rotation frequency $\omega$. With the control criterion value equal to the extreme one, the factor $F_o/Z_o$, rotation frequency $\omega$ and axial load P take the optimum values for the conditions of drilling the given rock.

If the optimizing controller 64 is connected via switch 67 to one of the inputs of the element 5 for comparison of the current value Z of drilling tool penetration per single revolution with the preset value $Z_o$ of such penetration, then the search by said controller for the extreme value of the operator-selected control criterion is accompanied with the adjustment of the present value $Z_o$ of drilling tool penetration per single revolution and, at the same time, drilling tool rotation frequency $\omega$ and axial load P. With the control criterion value equal to the extreme one, the penetration $Z_o$, axial load P and rotation frequency $\omega$ of the drilling tool assume the optimum values for the conditions of drilling the given rock.

If the optimizing controller 64 is connected directly to the input of the axial load regulator 2 or of the rotation frequency regulator 3, then the respective parameter, i.e., axial load P or rotation frequency $\omega$, is controlled separately, the value of the other parameter being constant.

Figure 12:
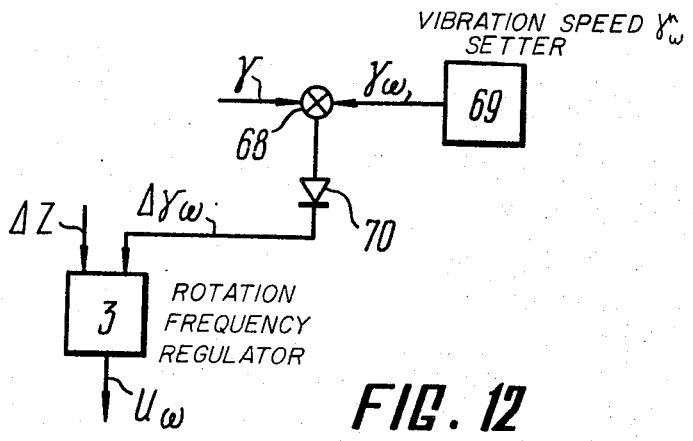
FIG. 12 is a block diagram of the unit for limiting the drilling tool rotation frequency, according to the present invention.
Figure 13:
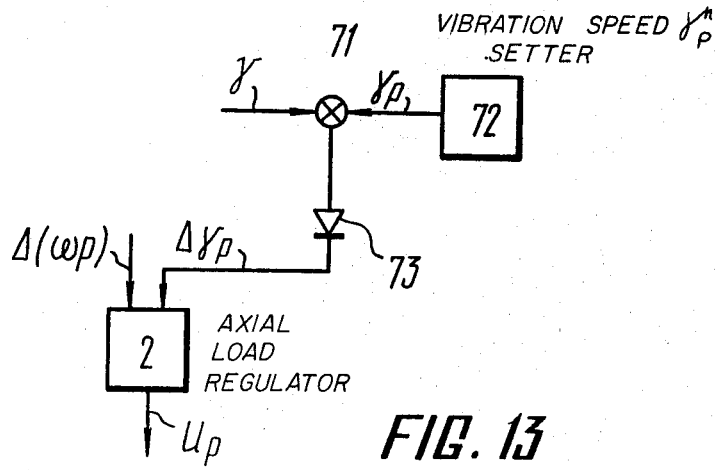
FIG. 13 is a block diagram of the unit for limiting the axial load on the drilling tool, according to the present invention.
Figure 14:
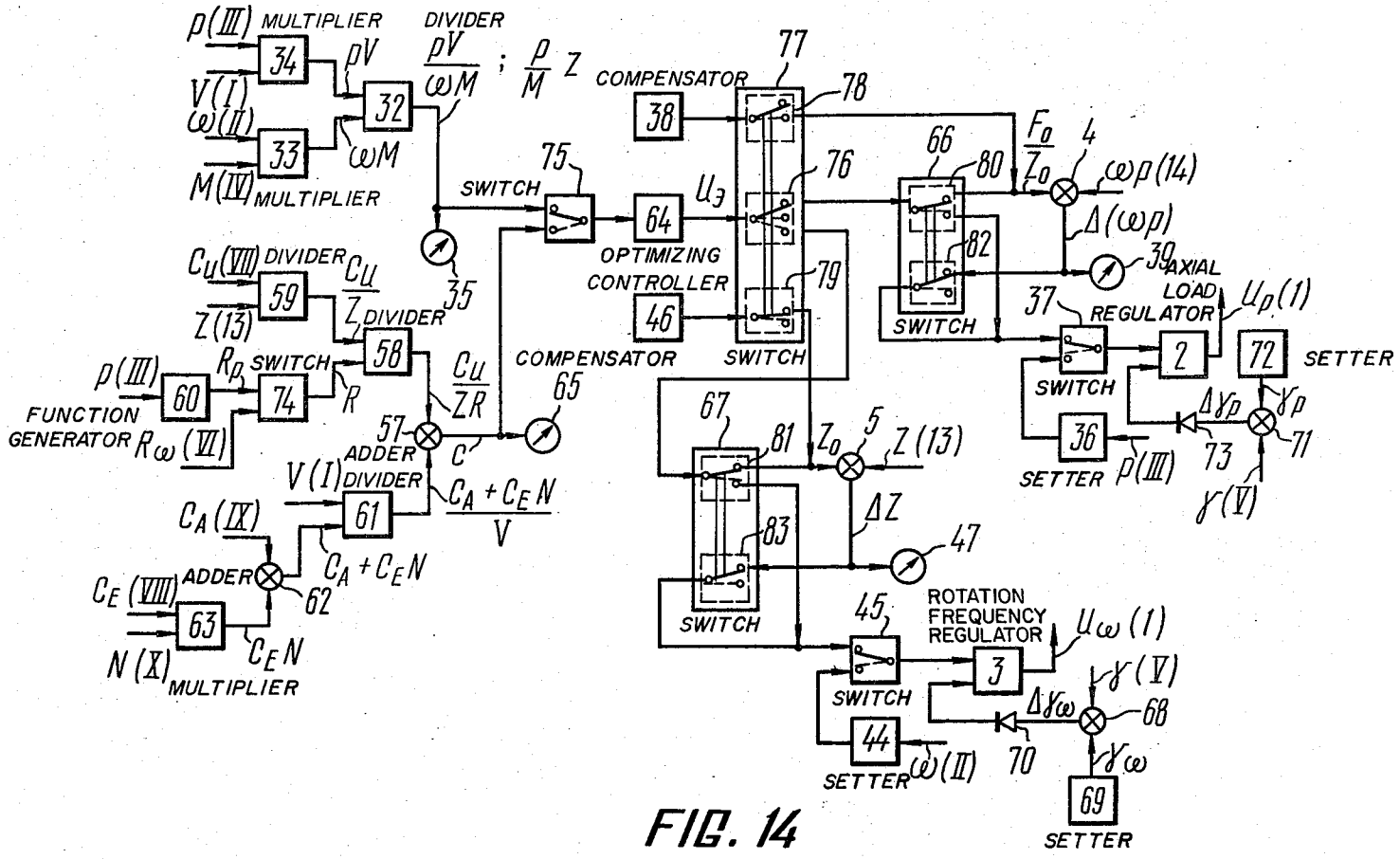
FIG. 14 is a general block diagram illustrating the optimum embodiment of computer means, according to the present invention.

In the automatic control system of the invention provision is made for on-line limitations of drilling tool axial load P and rotation frequency $\omega$ based on the permissible vibration speed $\gamma$ of the drill structure 1 and health norms for the servicing personnel. To this end, the computer 6 comprises a unit (FIG. 12) for limiting the drilling tool rotation frequency $\omega$ and a unit (FIG. 13) for limiting the axial load P on the drilling tool. The unit for limiting the drilling tool rotation frequency $\omega$ is made as an element 68 for comparison of the current value of vibration speed with the value $\gamma_\omega$ of vibration speed preset by means of a setter 69. The output of the comparison element 68 is connected via locking element 70 to the drilling tool rotation frequency regulator 3. When, in the course of the drill operation, the vibration speed value $\gamma$ exceeds the value $\gamma_\omega$ set by the setter 69, at the output of the element 68 for comparison of the current and preset values $\gamma$ and $\gamma_\omega$ of vibration speed there emerges a signal $\Delta\gamma_\omega$ which is supplied via locking element 70 to the input of the rotation frequency regulator 3 to reduce the drilling tool rotation frequency $\omega$.

The unit for limiting the drill tool axial load P is made as an element 71 for comparison of the current vibration speed value $\gamma$ with the vibration speed value $\gamma_P$ preset by a setter 72. The output of the comparison element 71 is connected via locking element 73 to the drilling tool axial load regulator 2.

When, in the course of the drill operation, the vibration speed value $\gamma$ exceeds the value $\gamma_P$ set by the setter 72, at the output of the element 71 for comparison of the current and preset vibration speed values $\gamma$ and $\gamma_P$ there emerges a signal $\Delta\gamma_P$ which is supplied via locking element 73 to the input of the drilling tool axial load regulator 2.

In the afore-described unit (FIG. 12) for limiting the drilling tool rotation frequency $\omega$ and unit (FIG. 13) for limiting the drilling tool axial load P, the elements 68, 69, 70, 71, 72, 73 have been left without detailed description since they are well known from literature (cf., E. D. Lebedev et al., Controlling D.C. Valve-Type Electric Motors, Energhiya Publishers, Moscow, 1970, in Russian).

It should be noted that the foregoing embodiments of individual units in the form of schematic diagrams may widely vary and are not limited to the electric circuits shown. For example, drill rotation frequency and axial load regulators, multiplication-division elements etc. can be made as electropneumatic or electrohydraulic devices and the like (cf., Pneumatic Control Means and Systems, Nauka Publishers, Moscow, 1970, in Russian).

All of the schematic diagrams shown in the accompanying drawings have been selected from the viewpoint of simplicity in describing the present invention.

With due regard for the foregoing, one can now draw schematically a general block diagram of the optimum embodiment of the computer means 6. This includes a unit for computing the control criterion selected as the ratio $PV/\omega M$ of the power PV of feeding the drilling tool to the hole face to the power $\omega M$ of drilling the rock with the drilling tool. This latter unit is fashioned as a divider 32 to whose inputs multipliers 33 and 34 are connected. Supplied to the input of the multiplier 34 from appropriate transducers are signals proportional to the current values of drilling tool axial load P and drilling rate V. Supplied to the input of the multiplier 33 from appropriate transducers are signals proportional to the current values of the drilling tool rotation frequency $\omega$ and torque M. The values of the power $\omega M$ of drilling the rock with the drilling tool and of the power PV of feeding the drilling tool to the hole face, obtained at the output of the multipliers 33 and 34, are applied to the input of the divider 32 at whose output there is computed the ratio $PV/\omega M$ of the feed power PV to drilling power $\omega M$. Provided at the output of the divider 32 is indicator 35 of the ratio $PV/\omega M$. The herein described unit for computing the control criterion is also used for computing the control criterion in the form of the product $(P/M)\cdot Z$ of the ratio of the drilling tool axial load P to torque M multiplied by the value Z of drilling tool penetration per single revolution when said value Z is preset as constant for all of the rocks being drilled.

The computer 6 further comprises a unit for computing the control criterion in the form of drilling cost C. The unit for computing the drilling cost C is made as an adder 57 whose one input is connected via intermediate divider 58 to an output of another divider 59 to whose inputs are supplied signals corresponding to the current value Z of drilling tool penetration per single revolution and to drilling tool cost $C_n$. Supplied to one of the inputs of the intermediate divider 58 from the divider 59 is the value of the ratio $C_n/Z$ of drilling tool cost $C_n$ to drilling tool penetration Z per single revolution, and to the other input, via motor potential switch 74, the value of drilling tool motor potential R either in the form of function $R_P$ of axial load P generated by a functional generator 60 for converting said load value or in the form of a preset constant value $R_\omega$. A second input of the adder 57 is connected via intermediate divider 61 to an output of an adder 62 to one to whose inputs there is supplied a signal $C_A$ corresponding to the cost of drilling tool depreciation and service personnel wages. Connected to a second input of the adder 62 is a multiplier 63 to whose inputs are supplied signal $C_E$ corresponding to the cost of one kilowatt-hour of electric energy and to power N consumed by the drill. To the second input of the intermediate divider 61 there is supplied from the drilling rate transducer 7 a signal corresponding to the current value of said rate V. Provided at the output of the adder 57 is an indicator 65 of the current value of drilling cost. The unit for computing the control criterion as drilling cost C is also used for computing particular cost criteria such as drilling tool-based drilling cost $C_n/ZR$, drilling cost $C_EN/V$ based on electric energy consumed by the drill, drilling cost $C_A/V$ based on the drill depreciation and personnel wages. To this end, said unit is provided with appropriate elements.

Both units for computing the control criterion are connected to an input of a switch 75 whose output is connected to the input of the optimizing controller 64. Via element 76 belonging to a switch 77 and having a three-position output, the output of the optimizing controller 64 is either connected via switch 66 to one of the inputs of the element 4 for comparison of the current value $\omega P$ of specific drillability F/Z with the optimum value $F_o/Z_o$ of the latter, or it is connected via switch 67 to one of the inputs of the element 5 for comparison of the current value Z of drilling tool penetration with the optimum value $Z_o$ of such penetration. The middle position of the element 76 of the switch 77 corresponds to the disconnected optimizing controller 64. In the middle position of the element 76 of the switch 77, a compensator 38 is connected to the input of the comparison element 4 via element 78 of the switch 77 while a compensator 46 is connected to the input of the comparison element 5 via element 79 of the switch 77. In case the optimizing controller 64 is connected via element 76 of the switch 77 and element 80 of the switch 66 to the input of the comparison element 4, then the compensator 46 is connected to the input of the comparison element 5 via element 79 of the switch 77. If the optimizing controller 64 is connected via element 76 of the switch 77 and element 81 of the switch 67 to the input of the comparison element 5, then the compensator 38 is connected to the input of the comparison element 4 via element 78 of the switch 77.

The output of the comparison element 4 is electrically connected, via element 82 of the switch 66 and a switch 37, to one of the inputs of the axial load regulator 2. An indicator 39 is connected at the output of the comparison element 4.

The output of the comparison element 5 is electrically connected, via element 83 of the switch 67 and switch 45, to one of the inputs of the drilling tool rotation frequency regulator 3. An indicator 47 is connected at the output of the comparison element 5.

A setter 36 is connected to another input of the switch 37. Supplied to the input of the setter 36 from the axial load transducer 9 is a feedback signal proportional to axial load P. A setter 44 is connected to another input of the switch 45. Supplied to the input of the setter 44 from the drilling tool rotation frequency transducer 8 is a feedback signal proportional to the drilling tool rotation frequency $\omega$.

The unit for limiting the drilling tool axial load P includes an element 71 for comparison of the current vibration speed value $\gamma$ with the vibration speed value $\gamma_P$ preset by a setter 72. The output of the comparison element 71 is connected via locking element 73 to the second input regulator 2 of the drilling tool of the axial load P.

The unit for limiting drilling tool rotation frequency $\omega$ includes an element 68 for comparison of the current vibration speed value $\gamma$ with the vibration speed value $\gamma_\omega$ preset by a setter 69. The output of the comparison element 68 is connected via locking element 70 to the second input of the drilling tool rotation frequency regulator 3.

The computer 6 can have several programs of operation. The operator of the drill 1 pre-selects the desired program.

The required control criterion is selected, which may be one of the following:

the ratio $PV/\omega M$ of the drilling tool feed power PV to rock drilling power $\omega M$. It is practical to use said criterion when drilling tough and loose rocks and those of low hardness. This criterion helps to perform drilling with low energy consumption due to unproductive losses such as vabriation of the drill 1, friction of the string of tools against the borehole walls, etc.;

the product (P/M)Z of the ratio of axial load P to torque M multiplied by the value Z of drilling tool penetration per single revolution. It is practical to use this criterion when drilling rocks of low hardness and tough rocks, with slow alternation of rocks with regard to physical-and-mechanical properties (such as hardness). In this case, drilling can be effected with a constant preset value Z of drilling tool penetration per single revolution;

drilling cost C. This criterion is practical when drilling hard rocks, with a rapid wear of the drilling tool calling for efficient utilization of said tool;

particular cost values such as drill tool cost $C_n/ZR$, the cost $C_A/V$ of the drill depreciation and service personnel wages, the cost $C_EN/V$ of electric energy consumed by the drill 1, and other combinations of particular cost values;

other control criteria such as hybrid ones, for example, when the rotation frequency $\omega$ is controlled according to the minimum drilling cost C while the axial load P is controlled according to the maximum ratio $PV/\omega M$ of the drilling tool feed power PV to rock drilling $\omega M$, and so on.

Discussed hereinbelow is the operation of the computer 6 in accordance with several main programs of automatic control.

The computer means enables one to effect automatic control over the drill 1 in accordance with preset values $F_o/Z_o$ of specific drillability factor and $Z_o$ of drilling tool penetration per single revolution. When the optimizing controller 64 is disconnected, with the element 76 of the switch 77 in the middle position, the compensator 38 is connected to the input of the element 4 for comparison of the current value of the product $\omega P$ of drilling tool rotation frequency by axial load P with the value $F_o/Z_o$ of specific drillability while the compensator 46 is connected at the input of the element 5 for comparison of the current value Z of drilling tool penetration per single revolution with the preset value $Z_o$ of such penetration. The axial load P is adjusted manually by means of the setter 36 until the indicator 35 or indicator 65, depending on the control criterion selected, displays the extreme (or preset by other conditions) value of the control criterion. The compensator 38 is used to compensate the current value of the signal $\omega P$ at one of the inputs of the comparison element 4 such that the difference $\Delta(\omega P)$ between the signal $\omega P$ and signal of the compensator 38 should be equal to zero. While so doing, the optimum value $F_o/Z_o$ of specific drillability will be set at the second input of the comparison element 4. The rotation frequency $\omega$ is adjusted manually by means of the setter 44 until the indicator 35 or indicator 65, depending on the control criterion selected, displays the extreme (or preset by other drilling conditions) value of the control criterion. The compensator 46 is used to compensate the current value of the signal Z at one of the inputs of the comparison element 5 such that the difference $\Delta Z$ between the signal Z and signal of the compensator 46 should be equal to zero. While so doing, the optimum value $Z_o$ of drilling tool penetration per single revolution will be set at the second input of the comparison element 5. The aforedescribed operations are repeated, if necessary. After setting the optimum values $F_o/Z_o$ of specific drillability and $Z_o$ of drilling tool penetration per single revolution, the setter 36 is disconnected by means of the switch 37 and setter 44 is disconnected by means of the switch 45, whereby the automatic control system is switched over to the mode of automatic control of the drilling process. After that, the system controls automatically the drilling tool rotation frequency $\omega$ and axial load P while maintaining, at the preset value of $F_o/Z_o$ and $Z_o$, specific drillability $\omega P$ and drilling tool penetration Z per single revolution.

When drilling rocks with a hardness rapidly varying in the course of drilling, the computer 6 provides the possibility of carrying out a continuous search for the optimum value $F_o/Z_o$ of specific drillability. By setting the switch 75 to the required position, a signal is applied to the input of the optimizing controller 64 proportional to the selected control criterion. The output of the optimizing controller 64 is connected via switch 77 and switch 66 of the input of the element 4 for comparison of the current value $\omega P$ of specific drillability with the preset optimum value $F_o/Z_o$ of said drillability. While so doing, the compensator 38 is disconnected from the input of the comparison element 4 by means of the element 78 of the switch 77. The optimizing controller 64 effects a continuous search for the extreme value of the control criterion by continuously adjusting its output signal $\mu_\theta$ proportional to the optimum value $F_o/Z_o$ of specific drillability. While so doing, the drilling tool axial load P is under continuous control in accordance with variations in the optimum value $F_o/Z_o$ of specific drillability. The drilling tool rotation frequency $\omega$ stays constant provided the rotation frequency setter 44 is connected at the input of the rotation frequency regulator 3 via switch 45. The rotation frequency $\omega$ is adjusted concurrently with the axial load P if the output of the element 5 for comparison of the current value Z of drilling tool penetration per single revolution with the preset value of such penetration is connected to the input of the rotation frequency regulator 3 via switches 45 and 67. In so doing, the preset value $Z_o$ of drilling tool penetration is supplied to one of the inputs of the comparison element 5 from the compensator 46 via switch 77.

When drilling rocks with a hardness rapidly varying in the course of drilling, the computer 6 provides the possibility of carrying out a continuous search for the optimum value $Z_o$ of drilling tool penetration per single revolution. By setting the switch 75 to the required position, a signal is applied to the input of the optimizing controller 64 proportional to the selected control criterion. The output of the optimizing controller 64 is connected via switch 77 and switch 67 to the input of the element 5 for comparison of the current value Z of drilling tool penetration per single revolution with the preset value $Z_o$ of such penetration. While so doing, the compensator 46 is disconnected by means of the element 79 of the switch 77 from the input of the element 5. The optimizing controller 64 effects a continuous search for the extreme value of the control criterion by continuously adjusting its output signal $U_3$ proportional to the current optimum value $Z_o$ of drilling tool penetration per signle revolution. While so doing, the drilling tool rotation frequency $\omega$ is under continuous control in accordance with variations in the optimum penetration value $Z_o$. The drilling tool axial load P stays constant provided the axial load setter 36 is connected at the input of the regulator 2. The axial load P is adjusted concurrently with the rotation frequency $\omega$ if the output of the element 4 is connected via the switches 37 and 66 to the input of the regulator 2 of the axial load for comparison of the current value $\omega P$ of specific drillability with the preset value $F_o/Z_o$ of said drillability. Said latter $F_o/Z_o$ preset value is supplied to one of the inputs of the comparison element 4 from the compensator 38 via switch 77.

The computer 6 provides the possibility of carrying out a direct search for the axial load P, based on the selected control criterion, by means of the optimizing controller 64. In this case, the output of the optimizing controller 64 is connected to the input of the axial load regulator 2 via element 76 of the switch 77, element 80 of the switch 66 and switch 37.

The computer 6, also provides the possibility of carrying out a direct search for the drilling tool rotation frequency $\omega$, based on the selected control criterion, by means of the optimizing controller 64. In this case, the output of the optimizing controller 64 is connected to the input of the drilling tool rotation frequency regulator 3 via element 76 of the switch 77, element 81 of the switch 67 and switch 45.

The computer 6 further provides the possibility of continuously adjusting the drilling tool axial load value P and rotation frequency value $\omega$ in accordance with the level of permissible vibration speed of the drilling tool or with the design of the drill 1.

The permissible level $\gamma_P$ of vibration speed is set by means of the vibration speed setter 72 and compared in the comparison element 71 with the current value $\gamma$ of vibration speed supplied from the vibration speed transducer 11. The difference between the current value $\gamma$ of vibration speed and its preset value $\gamma_P$, in case the value of signal proportional to the current vibration speed value exceeds that of signal proportional to the preset vibration speed value, is supplied via locking element 73 to the input of the axial load regulator 2 where it is added with opposite sign as compared with the main control signal supplied to the second input of the regulator 2. The drilling tool axial load P is reduced to a value corresponding to the permissible level $\gamma_P$ of the drilling tool vibration speed.

Analogously, with the aid of the setter 69 of the vibration speed level $\gamma_\omega$, comparison element 68 and locking element 70, there is shaped the signal for adjustment of rotation frequency $\omega$, which is then supplied to one of the inputs of the rotation, frequency regulator 3. The latter regulator reduces the drilling tool rotation frequency $\omega$ to a level at which the current value $\gamma$ of vibration speed does not exceed its preset value $\gamma_\omega$.

The specification contains no description of a specific embodiment of schematic diagram of the overall block diagram of the computer means 6 inasmuch as individual units thereof such as the unit for setting the value of drilling tool rotation frequency $\omega$ have been disclosed and described in detail above, or they are well known and used for their direct purpose such as multipliers and dividers.

The herein disclosed rotary drill automatic control system ensures the possibility of automatic or remote manual control over the drilling process, as well as of continuous generation of reliable information on the status and behavior of the drill in the course of drilling.

The information essential for proper functioning of the automatic control system is continuously generated on-line in the course of the drill operation and used directly for controlling the mode parameters in accordance with the control criterion selected by the operator prior to drilling from a set of criteria available in the automatic control system.

The system of the invention requires no preliminary acquisition of data for compiling adjustment programs or static statistical models, nor is there required the input of functional dependences interlinking the parameters and drilling characteristics.

However, if apriori information has been accumulated, it can be utilized in the system. The aforedescribed features facilitate the handling of the system and its adjustment before operation.

The control system provides for the minimum amount of data fed to the inputs in the form of coefficients which express in electrical terms the unit drilling tool cost, electric energy cost, the cost of drill depreciation and personnel wages, motor potential of the drilling tool. If necessary, the number of data fed to the control system can be increased.

The automatic control system of the invention is capable of operation without re-adjustment or preliminary acquisition of data in any field since the desired information is generated on-line in the course of drilling. It is sufficient to select a type of drilling tool suitable for the given field and supply appropriate cost coefficients to the system inputs.

The automatic control system of the present invention provides for the drill operation at the minimum energy consumption and cost of drilling, while ensuring a high drilling efficiency and drilling tool reliability.

What is claimed is:

1. A system for automatic control of a drilling rig utilizing a rotary drilling tool, comprising:

a drilling rate transducer connected to one of the outputs of said drilling rig;

a transducer of rotation frequency of said drilling tool, connected to a second one of the outputs of said drilling rig;

a transducer of axial load on said drilling tool, connected to a third one of the outputs of said drilling rig;

transducer of torque applied to said drilling tool, connected to a fourth one of the outputs of said drilling rig;

a transducer of vibration speed of said drilling tool, connected to a fifth one of the outputs of said drilling rig;

a unit for computing the value of penetration of said drilling tool per single revolution thereof connected to said drilling rate transducer and to said drilling tool rotation frequency transducer;

a unit for computing the current value of specific drillability of the rock being drilled, connected to said drilling tool rotation frequency transducer and to said drilling tool axial load transducer;

computer means designed for computing the optimum value of said specific drillability of the rock being drilled and the optimum value of penetration of said drilling tool per single revolution thereof, as well as for computing a signal for adjustment of the drilling tool rotation frequency and drilling tool axial load, said computer means comprising a first input connected to said drilling rate transducer, a second input connected to said drilling tool rotation frequency transducer, a third input connected to said drilling tool axial load transducer, a fourth input connected to said drilling tool torque transducer, a fifth input connected to said drilling tool vibration speed transducer, a sixth input to which is applied a signal proportional to the drilling tool motor potential, a seventh input to which is applied a signal proportional to the drilling tool cost value, an eighth input to which is applied a signal proportional to the cost of electric energy consumed by the drilling rig, a ninth input to which is applied a signal proportional to the cost of the drilling rig depreciation and service personnel wages, and a tenth input to which is applied a signal proportional to the power consumed by the drilling rig;

a first comparison element having one input connected to said unit for computing the current value of specific drillability and another input connected to one of the outputs of said computer means from which is supplied a signal proportional to the optimum value of specific drillability of the rock being drilled;

second comparison element having one input connected to said unit for computing the current value of drilling tool penetration and another input connected to a second output of said computer means from which is supplied a signal proportional to the optimum value of drilling tool penetration per single revolution thereof;

a drilling tool rotation frequency regulator having one input connected to the output of said second comparison element and another input connected to a fourth output of said computer means, the output of said regulator being connected to a second input of the drilling rig.

2. A drilling rig automatic control system as claimed in claim 1, comprising:

a drilling rate transducer connected to one of the outputs of said drilling rig;

a transducer of rotation frequency of said drilling tool, connected to a second one of the outputs of said drilling rig;

a transducer of axial load on said drilling tool, connected to a third one of the outputs of said drilling rig;

a transducer of torque applied to said drilling tool, connected to a fourth one of the outputs of said drilling rig;

a transducer of vibration speed of said drilling tool, connected to a fifth one of the outputs of said drilling rig;

a unit for computing the value of penetration of said drilling tool per single revolution thereof connected to said drilling rate transducer and to said drilling tool rotation frequency transducer;

a unit for computing the current value of specific drillability of the rock being drilled, connected to said drilling tool rotation frequency transducer and to said drilling tool axial load transducer;

computer means designed for computing the optimum value of said specific drillability of the rock being drilled and the optimum value of penetration of said drilling tool per single revolution thereof, as well as for computing a signal for adjustment of the drilling tool rotation frequency and drilling tool axial load, said computer means comprising a first input connected to said drilling rate transducer, a second input connected to said drilling tool rotation frequency transducer, a third input connected to said drilling tool axial load transducer, a fourth input connected to said transducer drilling tool torque transducer, a fifth input connected to said drilling tool vibration speed transducer, a sixth input to which is applied a signal proportional to the drilling tool motor potential, a seventh input to which is applied a signal proportional to the drilling tool cost value, an eighth input to which is applied a signal proportional to the cost of electric energy consumed by the drilling rig, a ninth input to which is applied a signal proportional to the cost of the drilling rig depreciation and service personnel wages, and a tenth input to which is applied a signal proportional to the power consumed by the drilling rig;

a first comparison element having one input connected to said unit for computing the current value of specific drillability and another input connected to one of the outputs of said computer means from which is supplied a signal proportional to the optimum value of specific drillability of the rock being drilled;

a second comparison element having one input connected to said unit for computing the current value of drilling tool penetration and another input connected to a second output of said computer means from which is supplied a signal proportional to the optimum value of drilling tool penetration per single revolution thereof;

a drilling tool axial load regulator including:

an amplifier whose one input is connected to the output of said first comparison element, and a second input is connected to said third output of said computer means;

a reversing servomotor having control windings and a rotor, said windings being connected to the output of said amplifier;

a hydraulic throttle kinematically connected to said rotor of said reversing servomotor;

a drilling tool rotation frequency regulator including:

an amplifier whose one input is connected to the output of said second comparison element, and a second input is connected to said fourth output of said computer means;

a reversing servomotor having control windings and a rotor, said windings being connected to the output of said amplifier;

a selsyn kinematically connected to said rotor of said reversing servomotor.

3. A drilling rig automatic control system as claimed in claim 1, wherein said computer means comprises a unit for computing the control criterion, said unit including:

a first multiplier having two inputs and an output, the first one of said inputs being connected to said drilling tool axial load transducer and the second one of said inputs being connected to said drilling rate transducer;

a second multiplier having two inputs and an output, the first one of said inputs being connected to said drilling tool rotation frequency transducer and the second one of said inputs being connected to said drilling tool torque transducer;

a divider having two inputs and an output, the first one of said inputs being connected to the output of said first multiplier and the second one of said inputs being connected to the output of said second multiplier;

an indicator having an input connected to the output of said divider.

4. A drilling rig automatic control system as claimed in claim 1, wherein said computer means comprises a unit for setting the value of axial load on the drilling tool, said unit including:

an axial load value setter;

a compensating unit;

a comparison element having one input connected to said compensating unit and another input connected to said unit for computing the current value of specific drillability;

a switch having one input connected to said comparison element and another input connected to said axial load value setter;

an axial load regulator connected to said switch;

an indicator connected to said comparison element.

5. A drilling rig automatic control system as claimed in claim 1, wherein said computer means comprises a unit for setting the value of axial load on the drilling tool, said unit including:

an axial load value setter having:

a first resistor whose input is connected to said axial load transducer;

a second resistor whose input is connected to said first resistor;

a switch having two inputs and an output, one of said inputs of said switch being connected to said second resistor;

an amplifier whose one input is connected to said switch and whose other input is connected to said third output of said computer means;

a compensator which includes a resistor having an input and two outputs, the input of said resistor being connected to a source of setting voltage;

an amplifier having two inputs and an output, one of the inputs of said amplifier being connected to said compensator while the other one of the inputs of said amplifier is connected to said comparison element;

a voltmeter whose input is connected to said other input of said switch.

6. A drilling rig automatic control system as claimed in claim 1, wherein said computer means comprises a unit for setting the value of drilling tool rotation frequency, said unit including:

a rotation frequency value setter;

a compensating unit whose input is connected to a source of setting voltage;

a comparison element whose one input is connected to said compensating unit and a second input is connected to said unit for computing the current value of drilling tool penetration per single revolution;

a switch whose one input is connected to said rotation frequency value setter and a second input is connected to said comparison element;

a rotation frequency regulator whose input is connected to said switch;

an indicator whose input is connected to said comparison element.

7. A drilling rig automatic control system as claimed in claim 1, wherein said computer means comprises a unit for setting the value of drilling tool rotation frequency, said unit including:

a rotation frequency value setter having:

a first resistor whose input is connected to said drilling tool rotation frequency transducer;

a second resistor whose input is connected to a source of setting voltage and to said first resistor;

a switch having two inputs and an output, the first one of said inputs being connected to said rotation frequency value setter;

an amplifier having two inputs, the first one of said inputs being connected to said switch and the second one of said inputs being connected to the fourth output of said computer means;

a compensator having:

a first resistor whose input is connected to a source of setting voltage;

a second resistor whose input is connected to said first resistor;

a third resistor whose input is connected to said second resistor;

a fourth resistor whose input is connected to said third resistor;

a fifth resistor whose input is connected to said fourth resistor;

a switch whose input is connected to said compensator;

an amplifier having two inputs and an output, the first one of said inputs being connected to said switch;

a voltmeter whose input is connected to said amplifier and to said second input of said switch.

8. A drilling rig automatic control system as claimed in claim 1, wherein said computer means comprises a unit for computing the drilling cost, said unit including:

a first divider having two inputs and an output, with a signal proportional to the drilling tool cost value being supplied to the first one of said inputs while the second one of said divider inputs is connected to said unit for computing the current value of drilling tool penetration per single revolution;

a functional generator for converting the value of drilling tool axial load to the motor potential of drilling tool, one input of said functional generator being connected to said axial load transducer;

a second divider having two inputs and an output, the first one of said inputs being connected to said first divider while the second one of said inputs is connected to said functional generator;

a multiplier having two inputs and an output, with a signal proportional to the electric energy cost being supplied to the first one of said inputs while to the second one of said inputs is supplied a signal proportional to the power consumed by said drilling rig;

a first adder having two inputs and an output, with a signal proportional to the cost of depreciation of said drilling rig and of the personnel wages while the second one of said inputs is connected to said multiplier;

a third divider having two inputs and an output, the first one of said divider inputs being connected to said drilling rate transducer while the second one of said divider inputs is connected to said first adder;

a second adder having two inputs and an output, the first one of said adder inputs being connected to said second divider while the second one of said adder inputs is connected to said third divider;

an optimizing controller whose input is connected to said second adder;

an indicator whose input is connected to said second adder.

9. A drilling rig automatic control system as claimed in claim 1, wherein said computing means comprises a unit of connecting an optimizing controller for controlling the axial load, said unit including:

a switch having an input and two outputs, said input being connected to the optimizing controller;

said comparison element for comparing the current value of specific drillability with the preset value of same, said element having two inputs and an output, the first one of said inputs being connected to the first output of said switch while the second one of said element inputs is connected to said unit for computing the current value of specific drillability.

10. A drilling rig automatic control system as claimed in claim 1, wherein said computer means comprises a unit of connecting an optimizing controller for controlling the drilling tool rotation frequency, said unit including:

a switch having an input and two outputs, said input being connected to the optimizing controller;

said comparison element for comparing the current value of drilling tool penetration per single revolution thereof with the preset value of such penetration, said element having two inputs and an output, the first one of said element inputs being connected to the first output of said switch while the second one of said inputs is connected to said unit for computing the current value of drilling tool penetration per single revolution thereof.

11. A drilling rig automatic control system as claimed in claim 7, wherein said computer means comprises a unit for limiting the drilling tool rotation frequency, said unit including:

a setter of the limiting value of drilling tool vibration speed;

an element for comparison of the limiting value of drilling tool vibration speed with the current value of said vibration speed, said element having two inputs and an output, the first one of said element inputs being connected to said setter while the second one of said inputs is connected to said vibration speed transducer;

a locking element whose input is connected to the output of said comparison element;

said drilling tool rotation frequency regulator having two inputs and an output, the first one of said regulator inputs being connected to the output of said locking element while the second one of said regulator inputs is connected to said element for comparison of the current value of drilling tool penetration with the preset value of such penetration.

12. A drilling rig automatic control system as claimed in claim 1, wherein said computer means comprises a unit for limiting the axial load on the drilling tool, said unit including:

a setter of the limiting value of drilling tool vibration speed;

an element for comparison of the limiting value of said vibration speed with the current value thereof, said element having two inputs and an output, one of said element inputs being connected to said setter while the other one of said inputs is connected to said vibration speed transducer;

a locking element whose input is connected to the output of said comparison element;

said drilling tool axial load regulator having two inputs and an output, the first one of said regulator inputs being connected to the output of said locking element while the second one of said inputs is connected to the element for comparison of the current value of specific drillability with the preset value thereof.

13. A drilling rig automatic control system as claimed in claim 1, wherein said computer means comprises a unit for computing the control criterion, said unit including:

a first multiplier having two inputs and an output, the first one of said inputs being connected to said drilling tool axial load transducer while the second one of said inputs is connected to said drilling rate transducer;

a second multiplier having two inputs and an output, the first one of said inputs being connected to said drilling tool rotation frequency transducer while the second one of said inputs is connected to said drilling tool torque transducer;

a divider having two inputs and an output, the first one of said divider inputs being connected to the output of said first multiplier while the second one of said inputs is connected to the output of said second multiplier;

an indicator having an input connected to the output of said divider;

a unit for computing the drilling cost, comprising:

a first divider having two inputs and an output, with a signal proportional to the drilling tool cost value being supplied to the first one of said divider inputs while the second one of said inputs is connected to said unit for computing the current value of drilling tool penetration per single revolution;

a functional generator for converting the value of drilling tool axial load to the drilling tool motor potential, said generator having one input connected to said axial load transducer;

a drilling tool motor potential switch having two inputs and an output, the first one of said inputs being connected to said functional generator while to the second one of said inputs a signal is applied proportional to the drilling tool motor potential value with respect to the drilling tool rotation frequency;

a second divider having two inputs and an output, the first one of said divider inputs being connected to said first divider while the second one of said inputs is connected to said drilling tool motor potential switch;

a multiplier having two inputs and an output, with a signal proportional to the cost of electric energy being supplied to the first one of said multiplier inputs while to the second one of said inputs a signal is supplied porportional to the power consumed by said drilling rig;

an adder having two inputs and an output, with a signal proportional to the cost of depreciation of said drilling rig and personnel wages being supplied to the first one of said adder inputs while the second one of said inputs is connected to said multiplier;

a third divider having two inputs and an output, the first one of said inputs being connected to said drilling rate transducer while the second one of said inputs is connected to said adder;

a second adder having two inputs and an output, the first one of said inputs being connected to said second divider while the second one of said inputs is connected to said third divider;

an indicator of the drilling cost value, the input of said indicator being connected to said second adder;

a control criterion switch having two inputs and an output, the first one of said inputs being connected to said divider of said unit for computing the control criterion while the second one of said inputs is connected to said second adder of said unit for computing the drilling cost;

an optimizing controller connected to said control criterion switch;

a compensator of the current value of specific drillability;

a compensator of the current value of drilling tool penetration per single revolution thereof;

a first switch having three inputs and five outputs, the first one of said inputs being connected to said compensator of the current value of specific drillability while the second one of said inputs is connected to said optimizing controller and the third one of said inputs is connected to said compensator of the current value of drilling tool penetration per single revolution thereof;

a second switch having two inputs and three outputs, the first one of said switches being connected to said second output of said first switch while the second one of said inputs is connected to the output of said element for comparison of the current value of specific drillability with the preset value thereof;

said element for comparison of the current value of specific drillability with the preset value thereof having two inputs and an output, the first one of said inputs being connected to said first output of said first switch and to said first output of said second switch;

an axial load setter connected to said axial load transducer and to a supply voltage source;

a third switch having two inputs and an output, the first one of said inputs being connected to said axial load setter while the second one of said inputs is connected to said second output of said second switch and to said third output of said second switch;

a first setter of the limiting value of drilling tool vibration speed;

a first element for comparison of the preset value of vibration speed with the current value thereof, having two inputs and an output, the first one of said inputs being connectes to said setter of the limiting value of drilling tool vibration speed while the second one of said inputs is connected to said vibration speed transducer;

a first locking element connected to said output of said element for comparison of the preset value of vibration speed with the current value thereof;

said axial load regulator having two inputs and an output, the first one of said inputs being connected to said third switch while the second of said inputs is connected to said locking element;

a fourth switch having two inputs and three outputs, the first one of said inputs being connected to said fourth output of said first switch while the second one of said inputs is connected to the output of said element for comparison of the current value of drilling tool penetration per single revolution thereof with the preset value of such penetration;

said element for comparison of the current value of drilling tool penetration per single revolution thereof with the preset value of such penetration, having two inputs and an output, the first one of said inputs being connected to said first output of said fourth switch and to said fifth output of said first switch;

a setter of drilling tool rotation frequency, connected to said drilling tool rotation frequency transducer and to a supply voltage source;

a fifth switch having two inputs and an output, the first one of said inputs being connected to said setter of drilling tool rotation frequency while the second one of said inputs is connected to said second output and said third output of said fourth switch;

a second setter of the limiting value of drilling tool vibration speed;

a second element for comparison of the preset value of vibration speed with the current value thereof, having two inputs and an output, the first one of said inputs being connected to said second setter of the limiting value of vibration speed while the second one of said inputs is connected to said vibration speed transducer;

a second locking element connected to said output of said second element for comparison of the preset value of vibration speed with the current value thereof;

said drilling tool rotation frequency regulator having two inputs and an output, the first one of said inputs being connected to said fifth switch while the second one of said inputs is connected to said second locking element.

* * * * *